US006508677B1

(12) United States Patent
Wang

(10) Patent No.: US 6,508,677 B1
(45) Date of Patent: Jan. 21, 2003

(54) LOW PROFILE MODULAR JACK

(75) Inventor: Suiya Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/005,735

(22) Filed: Nov. 6, 2001

(51) Int. Cl.[7] ..... H01R 23/02

(52) U.S. Cl. ..... 439/676; 439/609; 439/660; 439/418

(58) Field of Search ..... 439/676, 606, 439/604, 607, 609, 610; 29/883, 858, 881, 843; 436/67, 76.1

(56) References Cited

U.S. PATENT DOCUMENTS 5,178,563 A * 1/1993 Reed ..... 439/676
5,358,430 A * 10/1994 Bonvallat et al. ..... 439/676
5,803,770 A * 9/1998 Swendson et al. ..... 439/676
5,885,111 A * 3/1999 Yu ..... 439/676

* cited by examiner

*Primary Examiner*—P. Austin Bradley
*Assistant Examiner*—Alexander Gilman
(74) *Attorney, Agent, or Firm*—Wei Te Chung

(57) ABSTRACT

A modular jack (1) comprises a housing (2) and a terminal module (3) received in the housing. The terminal module comprises a base (30) and a plurality of terminals (31) retained in the base. Each terminal comprises a mounting portion (311), a tail portion (312) extending upwardly from a rear end of the mounting portion for connecting with a corresponding conductor (90) of a cable (9), and an inclined contacting portion (313) extending upwardly from a front end of the mounting portion. The mounting portions and tail portions of the terminals and the conductors are insert molded with the base.

2 Claims, 5 Drawing Sheets

5

LOW PROFILE MODULAR JACK

BACKGROUND OF THE INVENTION

1. Field of the Invention

The present invention relates to a modular jack, and particularly to a modular jack with a reduced height.

2. Description of Related Art

Modular jack is widely used in a computer communication network or a wire telephone network. A conventional modular jack comprises an insulative housing, and a plurality of terminals assembled in the housing for connecting with mating contacts of a complementary plug connector and conductors of a mating cable at opposite ends. The terminals connect with the conductors of the cable at a horizontal rear end of the housing. However, when the cable is subjected to an external force in a horizontal direction, the connection between the terminals and the conductors is easy to break. A modular jack disclosed in Taiwan Patent Application No. 76209220 overcomes the aforesaid disadvantage. Referring to FIG. 5, a modular jack 5 comprises an insulative housing 50, and a plurality of terminals 51 assembled in the housing 50. The housing 50 comprises a receiving space 500 for receiving a complementary plug connector 6, and a plurality of front-to-back through passageways 501 at a bottom wall of the housing 50 communicating with the receiving space 500 for receiving the terminals 51. Each terminal 51 comprises a mounting portion 511 received in the passageway 501, a spring contacting portion 512 extending slantways upwardly from a front end of the mounting portion 511 to mate with the plug connector 6, and a tail portion 513 extending rearwardly from a rear end of the mounting portion 511 to electrically contact with a mating cable 7. The cable 7 comprises a contact 71 electrically assembled on a free end thereof to securely contact with the tail portion 513. However, the bottom wall of the housing 50 must be thick enough to hold the cable 7 and the tail portion 513, which will heighten the modular jack 5.

Hence, an improved modular jack is required to overcome the disadvantages of the conventional modular jack.

SUMMARY OF THE INVENTION

Accordingly, one object of the present invention is to provide a modular jack with a reduced height.

Another object of the present invention is to provide a modular jack which ensures a reliable connection between its contacts and a corresponding cable.

In order to achieve the object set forth, a modular jack in accordance with the present invention comprises an insulative housing and a terminal module received in the housing. The housing comprises a top wall, an opposite bottom wall and a pair of opposite side walls together defining a longitudinal receiving space for receiving a complementary plug connector and the terminal module. Each of the side walls defines a first recess at a rear end thereof and a second recess communicating with the first recess. The terminal module comprises a dielectric base and a plurality of terminals received in the base. The base comprises a pair of opposite spring arms to be received in the first recess. Each of the spring arms comprises a protrusion for being received in the second recess to securely retain the terminal module in the receiving space. Each of the terminals comprises a mounting portion, a tail portion extending upwardly from a rear end of the mounting portion, and a spring contacting portion extending upwardly and rearwardly from a front end of the mounting portion. In manufacturing, the mounting portions, the tail portions of the terminals, and corresponding conductors of a cable connected with the tail portions are together insert molded with the base. The terminals connect with the conductors of the cable at a top end of the housing, so the bottom wall of the housing needs not to be too thick and thus reduces the height of the modular jack. In addition, the connection between the tail portions and the conductors of the cable is not easy to break off.

Other objects, advantages and novel features of the invention will become more apparent from the following detailed description when taken in conjunction with the accompanying drawings.

DETAILED DESCRIPTION OF THE INVENTION

Figure 1:
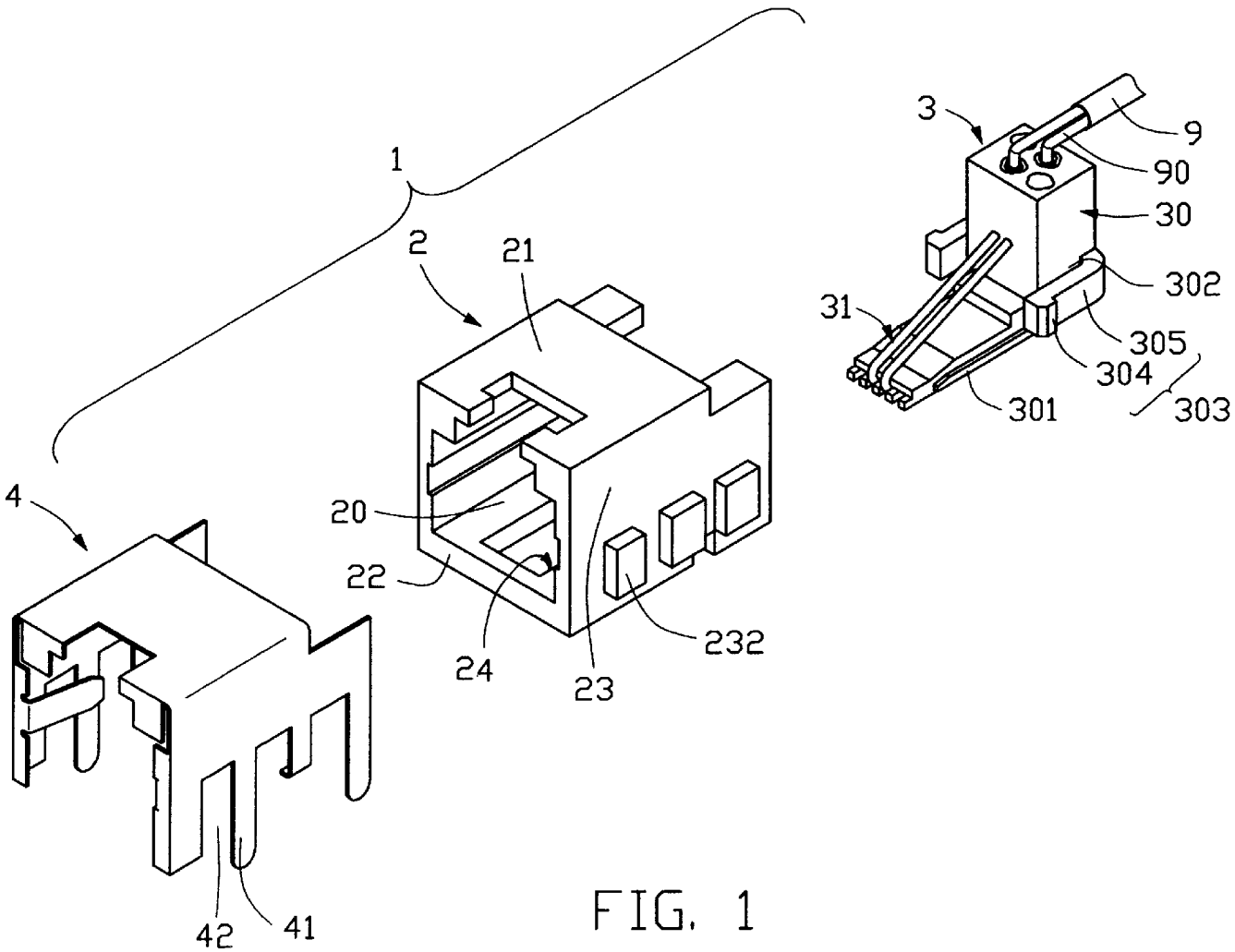
FIG. 1 is a perspective, exploded view of a modular jack of the present invention.

Reference will now be made to the drawing figures to describe the present invention in detail.

Referring to FIG. 1, a modular jack 1 in accordance with the present invention comprises an insulative housing 2, a terminal module 3 for being assembled in the housing 2, and a shield 4 for enclosing the housing 2.

Figure 2:
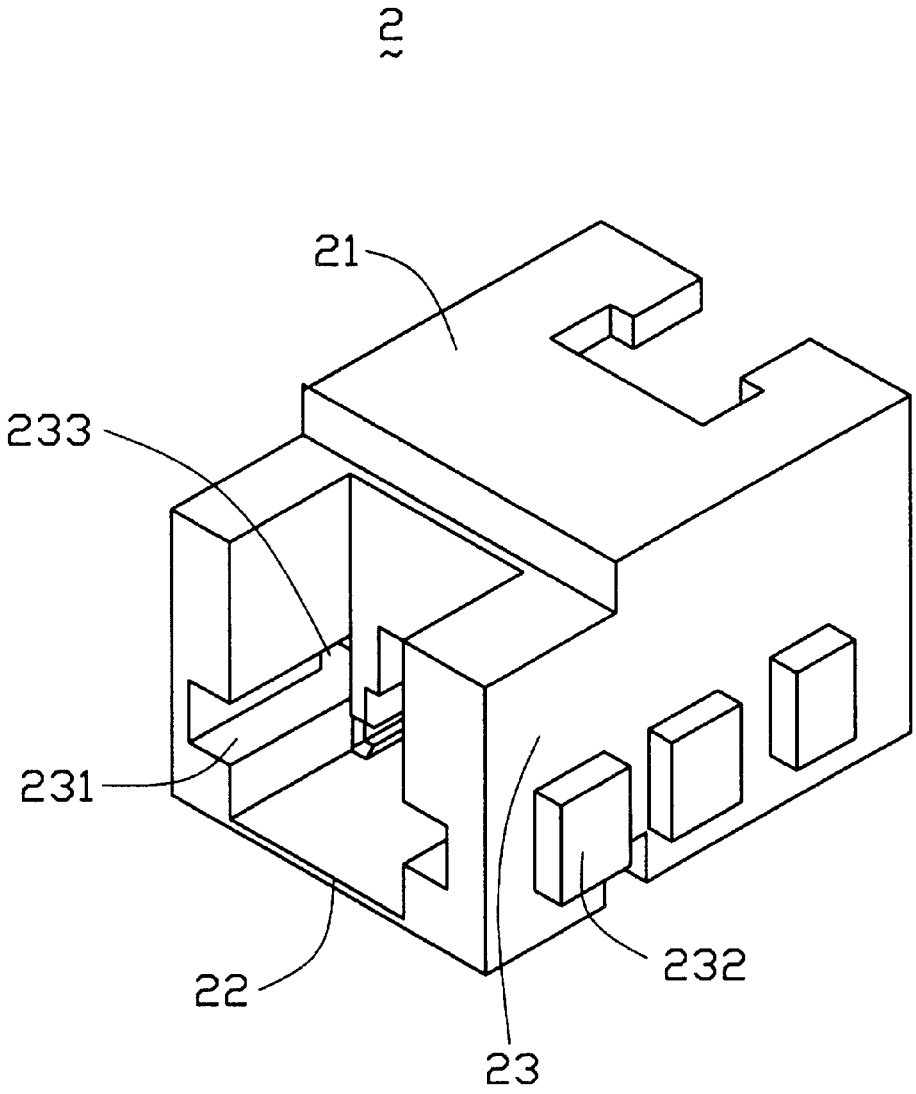
FIG. 2 is a perspective, rear view of an insulative housing of the modular jack in FIG. 1.

Also referring to FIG. 2, the insulative housing 2 comprises a top wall 21, an opposite bottom wall 22, and a pair of opposite side walls 23 together defining a receiving space 20 for receiving a complementary plug connector (not shown) and the terminal module 3. Each of the side walls 23 comprises three projections 232, and a recess in an inner face at a rear end thereof. The recess includes a first longitudinal recess 231 and a second recess 233 communicating with the first recess 231.

Figure 3:
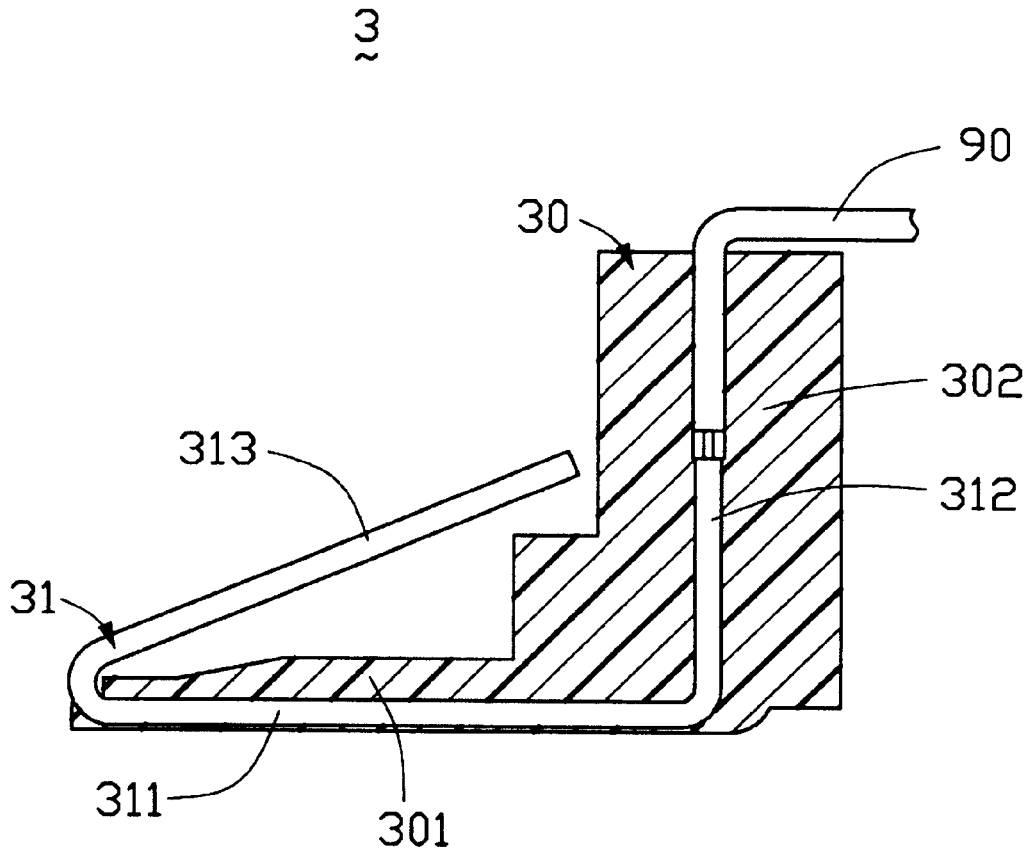
FIG. 3 is a cross-sectional view of a terminal module of the modular jack with a cable connected thereof.

Also referring to FIG. 3, the terminal module 3 comprises a dielectric base 30 and a plurality of terminals 31 retained in the base 30. The base 30 comprises a horizontal portion 301, an integral vertical portion 302 and a pair of opposite spring arms 303 extending forwardly from opposite transverse sides of the vertical portion 302. Each of the spring arms 303 comprises a body 305 and a protrusion 304 extending outwardly from a front end of the body 305. Each of the terminals 31 comprises a horizontal mounting portion 311, a vertical tail portion 312 extending upwardly from a rear end of the mounting portion 311 for connecting with a conductor 90 of a cable 9 and a spring contacting portion 313 extending rearwardly and upwardly from a front end of the mounting portion 311 for contacting with a corresponding mating contact of the plug connector.

The shield 4 comprises four legs 41 extending downwardly from a bottom edge of each transverse side of the shield 4. Every two legs 41 define a space 42 therebetween for receiving a corresponding projection 232, thereby securely retaining the shield 4 around the housing 2.

In manufacturing, the tail portions 312 of the terminals 31 are soldered to the conductors 90 of the cable 9.

Figure 4:
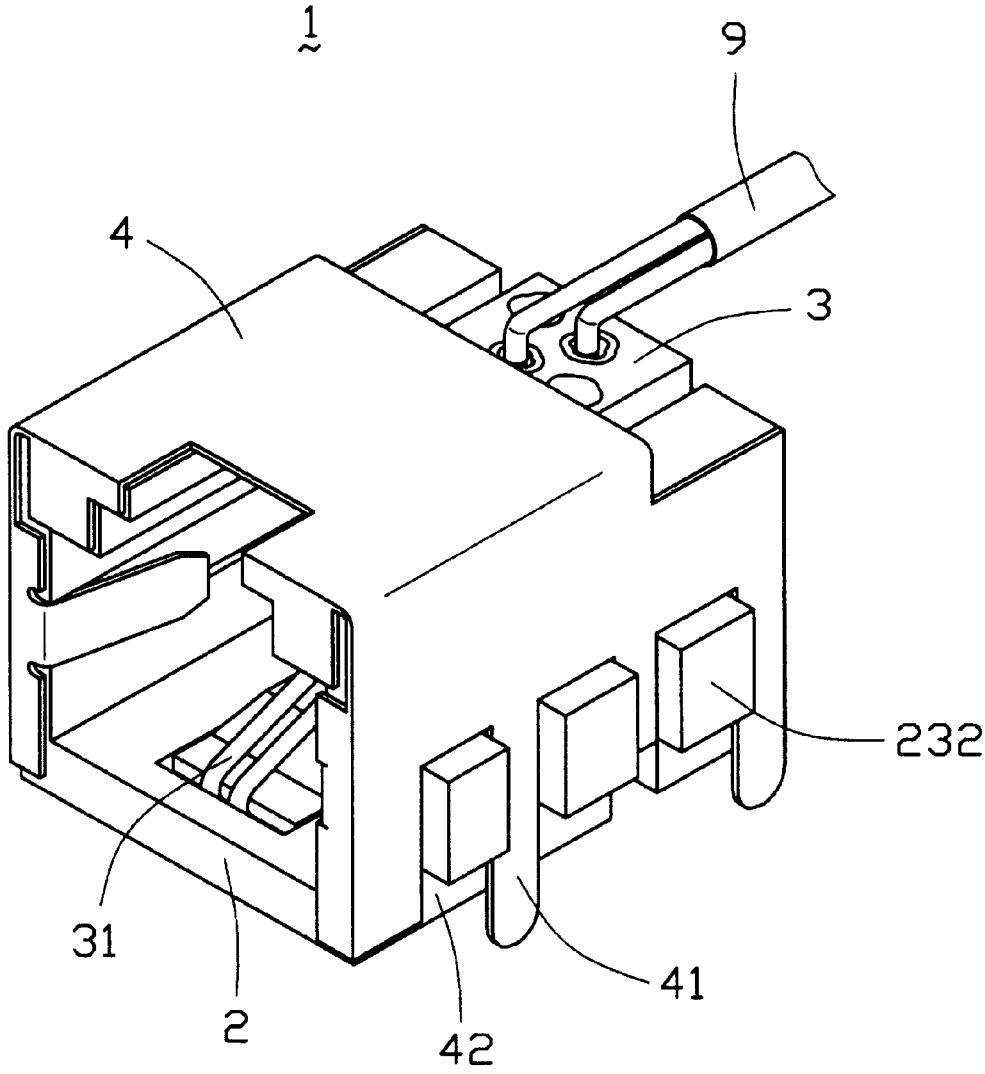
FIG. 4 is an assembled view of the modular jack in FIG. 1.
Figure 5:
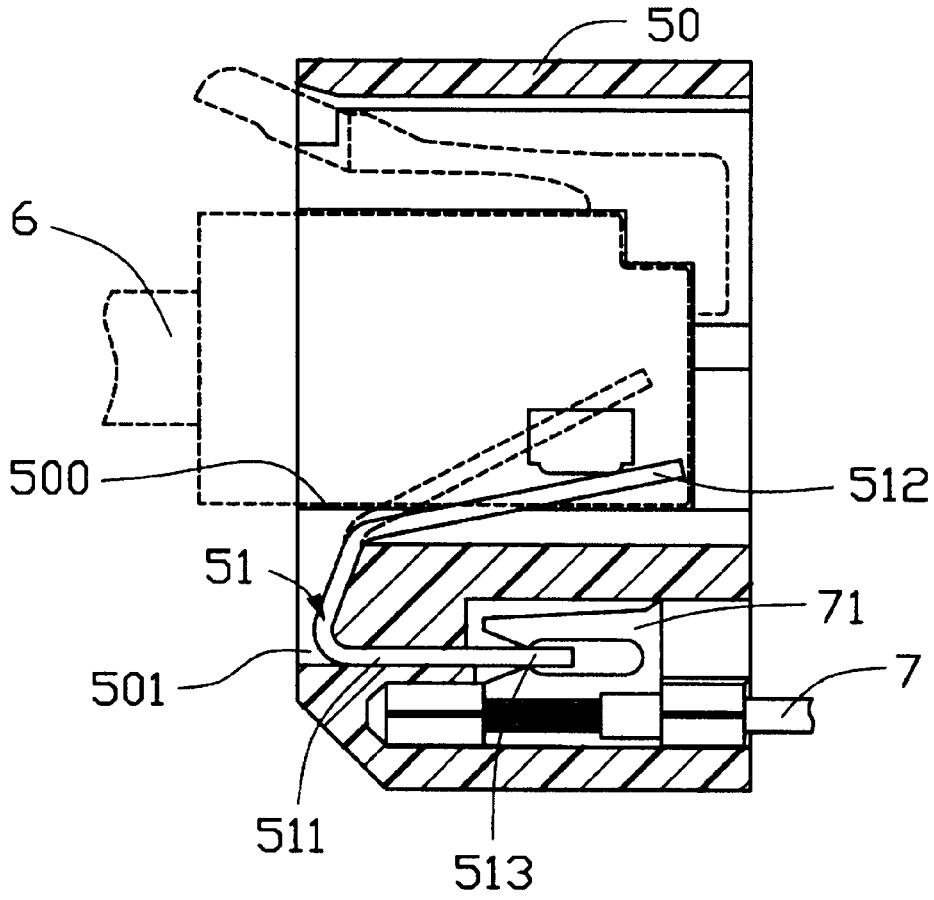
FIG. 5 (PRIOR ART)
FIG. 5 is a cross-sectional view of a conventional modular jack.

Subsequently, the mounting portions 311, the tail portions 312 and the conductors 90 are together insert molded with the base 30, thereby forming the terminal module 3. Also referring to FIG. 4, in assembly, the terminal module 3 is placed in the receiving space 20 from a rear end of the housing 2 with the horizontal portion 301 of the base 30 received within the recess 24, the bodies 305 of the spring arms 303 elastically received in the first recesses 231 of the housing 2 and with the protrusions 304 received in the second recesses 233. Finally, the shield 4 encloses the housing 2 with the projections 232 being received in the spaces 42 defined between the legs 41.

In the present invention, the terminals 31 connect with the conductors 90 of the cable 9 at a top end of the terminal module 3, so it is not necessary for the modular jack 1 to have a thick bottom wall 22 as a conventional modular jack. Therefore, the height of the modular jack 1 is reduced. In addition, since the tail portions 312 of the terminal 31 and the conductors 90 of the cable 9 are insert molded with the base 30, the connection between the terminals 31 and the cable 9 is protected and thus reliable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a cable having a plurality of conductors; and a modular jack comprising an insulative housing defining a longitudinal receiving space and a terminal module received in the receiving space, the terminal module comprising a dielectric base, having a horizontal and vertical portions and a plurality of terminals, each terminal comprising a mounting portion retained in the horizontal portion of dielectric base, a tail portion extending upwardly from a rear end of the mounting portion and connected with a corresponding conductor of the cable, in the vertical portion of the base and an inclined contacting portion extending upwardly from a front end of the mounting portion; wherein the mounting portions, the tail portions of the terminals and the conductors of the cable are insert molded within the dielectric base, whereby an electrical connection between the tails and the corresponding conductors being established, of the modular jack.

2. The cable assembly as described in claim 1, wherein the recess includes a first recess and a second recess communicating with the first recess, and the spring arm comprises a body received in the first recess and an outwardly extending protrusion received in the second recess for securely retaining the terminal module in the housing.

* * * * *